US011236474B2

(12) United States Patent
Fazio

(10) Patent No.: US 11,236,474 B2
(45) Date of Patent: Feb. 1, 2022

(54) RAILWAY FASTENER FOR USE WITH CROSSTIES

(71) Applicant: Pandrol Limited, Surrey (GB)

(72) Inventor: Anthony Fazio, Havertown, PA (US)

(73) Assignee: PANDROL LIMITED, Surrey (GB)

( * ) Notice: Subject to any disclaimer, the term of this patent is extended or adjusted under 35 U.S.C. 154(b) by 437 days.

(21) Appl. No.: 16/217,966

(22) Filed: Dec. 12, 2018

(65) Prior Publication Data

US 2019/0177931 A1 Jun. 13, 2019

Related U.S. Application Data

(60) Provisional application No. 62/597,576, filed on Dec. 12, 2017.

(51) Int. Cl.

| | |
|---|---|
| ***E01D 19/12*** | (2006.01) |
| ***E01B 26/00*** | (2006.01) |
| ***E01B 3/00*** | (2006.01) |

(52) U.S. Cl.

CPC ..... *E01D 19/12* (2013.01); *E01B 3/00* (2013.01); *E01B 26/00* (2013.01); *E01B 2201/02* (2013.01)

(58) Field of Classification Search

CPC ..... E01B 3/00; E01B 9/00; E01B 9/02; E01B 9/28; E01B 9/30; E01B 9/38; E01B 26/00; E01D 19/12

See application file for complete search history.

(56) References Cited

U.S. PATENT DOCUMENTS

| | | | |
|---|---|---|---|
| 3,552,649 | A | 1/1971 | Burwell |
| 4,561,589 | A | 12/1985 | Hixson |
| 4,795,091 | A | 1/1989 | Burwell |
| 7,080,791 | B2 | 7/2006 | Geissele et al. |
| 9,512,573 | B2 | 12/2016 | Austin et al. |

FOREIGN PATENT DOCUMENTS

| | | | |
|---|---|---|---|
| DE | 10353213 | 10/2005 | |
| JP | 2005299093 | 10/2005 | |
| JP | 2006077504 | 3/2006 | |
| JP | 3854611 B2 * | 12/2006 | ..... E01B 1/00 |
| JP | 2017014709 | 1/2017 | |

OTHER PUBLICATIONS

Examination Report, Canadian Intellectual Property Office, corresponding Application No. 3,028,413, dated Dec. 17, 2019.

* cited by examiner

*Primary Examiner* — Robert J McCarry, Jr.
(74) *Attorney, Agent, or Firm* — Gottlieb, Rackman & Reisman, PC

(57) ABSTRACT

A fastening system configured to attach railroad crossties to one or more support structures such as the girder of a bridge. The fastening system includes a plate mounted on a crosstie and a clip attached to the plate that is configured to provide a force between the support structure and the crosstie and secure the crosstie in place.

10 Claims, 4 Drawing Sheets

RAILWAY FASTENER FOR USE WITH CROSSTIES

CROSS-REFERENCE TO RELATED APPLICATION

This application claims priority to U.S. Provisional Patent Application No. 62/597,576, filed Dec. 12, 2017, which is hereby incorporated by reference in its entirety as part of the present disclosure.

FIELD OF THE INVENTION

This disclosure relates generally to railroad systems and more specifically to railway fastening systems for use with crossties when fastened to steel structures such as bridges having girders.

BACKGROUND OF THE INVENTION

In conventional railroad systems, rails are supported on crossties using rail support assemblies. One such assembly is shown and described in commonly assigned U.S. Pat. No. 4,561,589 to Hixson. As shown in FIG. 1, a rail seat assembly 10 supports a rail 12 on a wooden crosstie 14. The rail 10 includes a web 16 and flanges 18. The rail seat assembly 10 includes a tie plate 20 that is seated on the crosstie 14 and supports two clips 22 that each engages one of the flanges 18 of rail 12.

Commonly, the crossties 14 are disposed on railroad beds. However, when railroad tracks run over bridges or other steel structures, special supports are needed to attach the crossties to these structures. One such support structure is disclosed in U.S. Pat. No. 4,795,091 to Burwell, which discloses a railway fastening system that includes a resilient clip that is designed to engage and secure a crosstie to a steel girder. The clip is fastened to the crosstie with a bolt passing vertically through the wooden crosstie. The support must be mounted below the crosstie and, therefore, is difficult and time consuming to install. Moreover, over time, the vertical bolt weakens the crosstie, increases wear and tear of the crosstie and the head of the clip poses a tripping hazard. Additionally, because the clip is disposed under the tie, it is difficult to determine when the clip is properly positioned during installation, or whether the clip has been corroded by extensive wear and tear and exposure to extreme weather conditions and, as a result, needs to be replaced. There are similar problems with U.S. Pat. No. 3,552,649 to Burnwell.

U.S. Pat. No. 9,512,573 to Austin, et al. shows a support system that includes a horizontal bar mounted by vertical spikes on top of two adjacent crossties. A spring loaded bolt extends from the horizontal bar downwardly between the crossties and terminates with a hook engaging the top of a girder. Again, the spikes weaken the crossties and the horizontal bar and bolt extend above the crossties and as a result, present a tripping hazard. Moreover the system is difficult to install correctly.

SUMMARY OF THE INVENTION

Broadly, the present disclosure is directed to a resilient fastener assembly that engages both a railway crosstie and a supporting structure (e.g., a steel girder). Tension on the resilient fastener transfers a lateral and a vertical force between the crosstie and the supporting structure. The fastener assembly includes a plate mounted to vertical fascia of the crosstie from which at least one flange extends and a clip that extends through an opening in the flange to secure the crosstie to a supporting structure.

It is an objective of the present invention to improve railway fastening of crossties to support structures, such as steel girder beams and in turn prevent the crosstie from movement.

It is another objective of the present intention to improve occupational safety for the installation of crossties on structures and increase the efficiency of the installation of crossties on supporting structures.

A still further objective of the present invention is to provide a railway fastening device that does not interfere with the support structure, secures the crosstie from lateral and vertical movement.

A yet further objective of the present invention is to remove tripping hazards of conventional railway crosstie fastening to structures by removing hardware for crosstie fastening clear of the crosstie top horizontal surface and installing it on the crosstie's vertical surface.

DETAILED DESCRIPTION OF THE EMBODIMENTS

Figure 1:
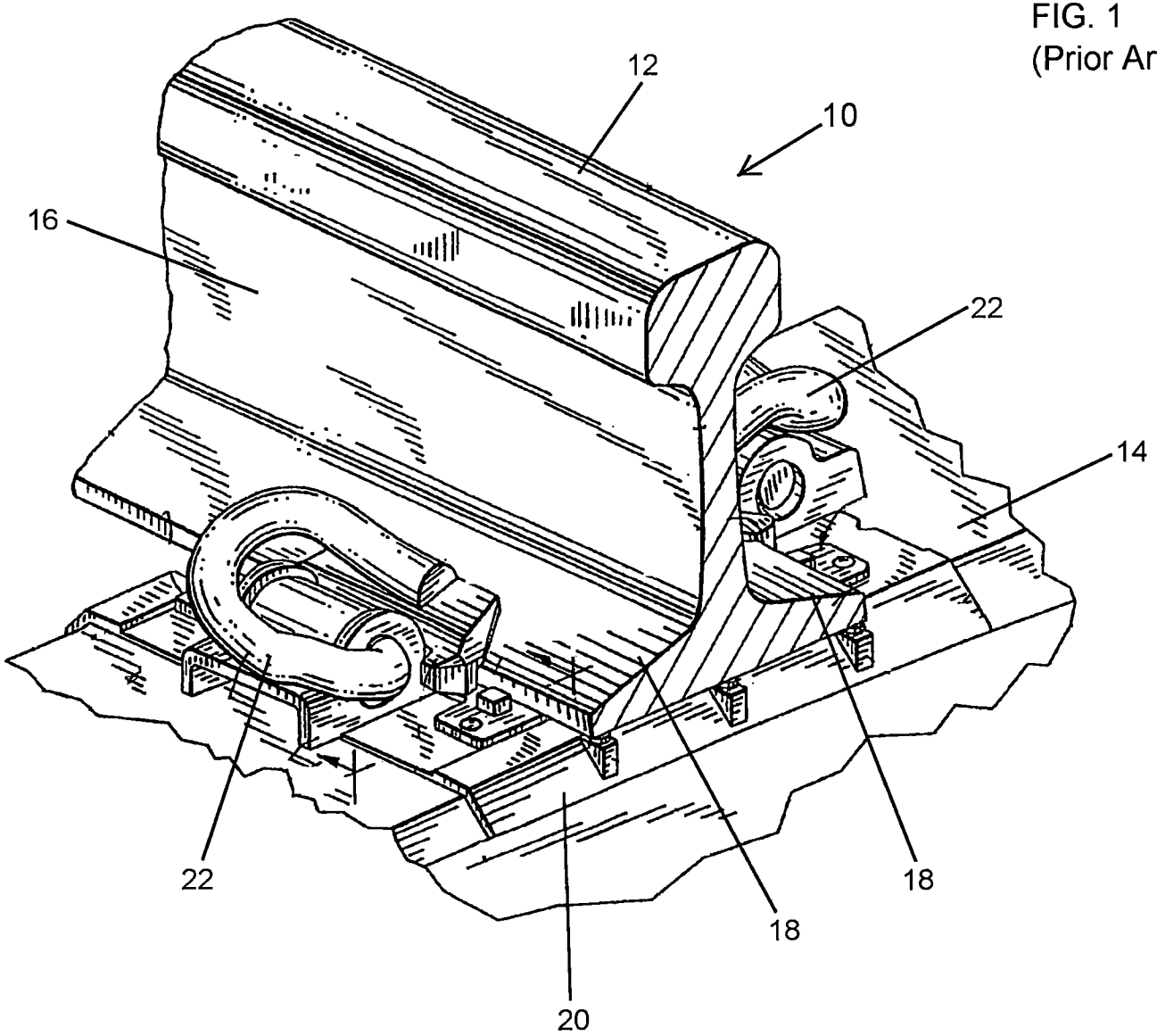
FIG. 1 (Prior Art)
FIG. 1 is a perspective view of a known fastening system for a railroad tie.

With reference to the drawings, wherein the same reference number indicates the same element throughout, exemplary embodiments of a railway fastener will be described.

As described above, FIG. 1 illustrates a known rail seat assembly 10 that includes a rail 12 that includes a web 16 and flanges 18 seated on a tie plate 20 that is secured to a crosstie 14. The rail 12 is secured to the crosstie 14 by clips 22 that are engage the flanges 18 of the rail 12.

Figures 2, 3:
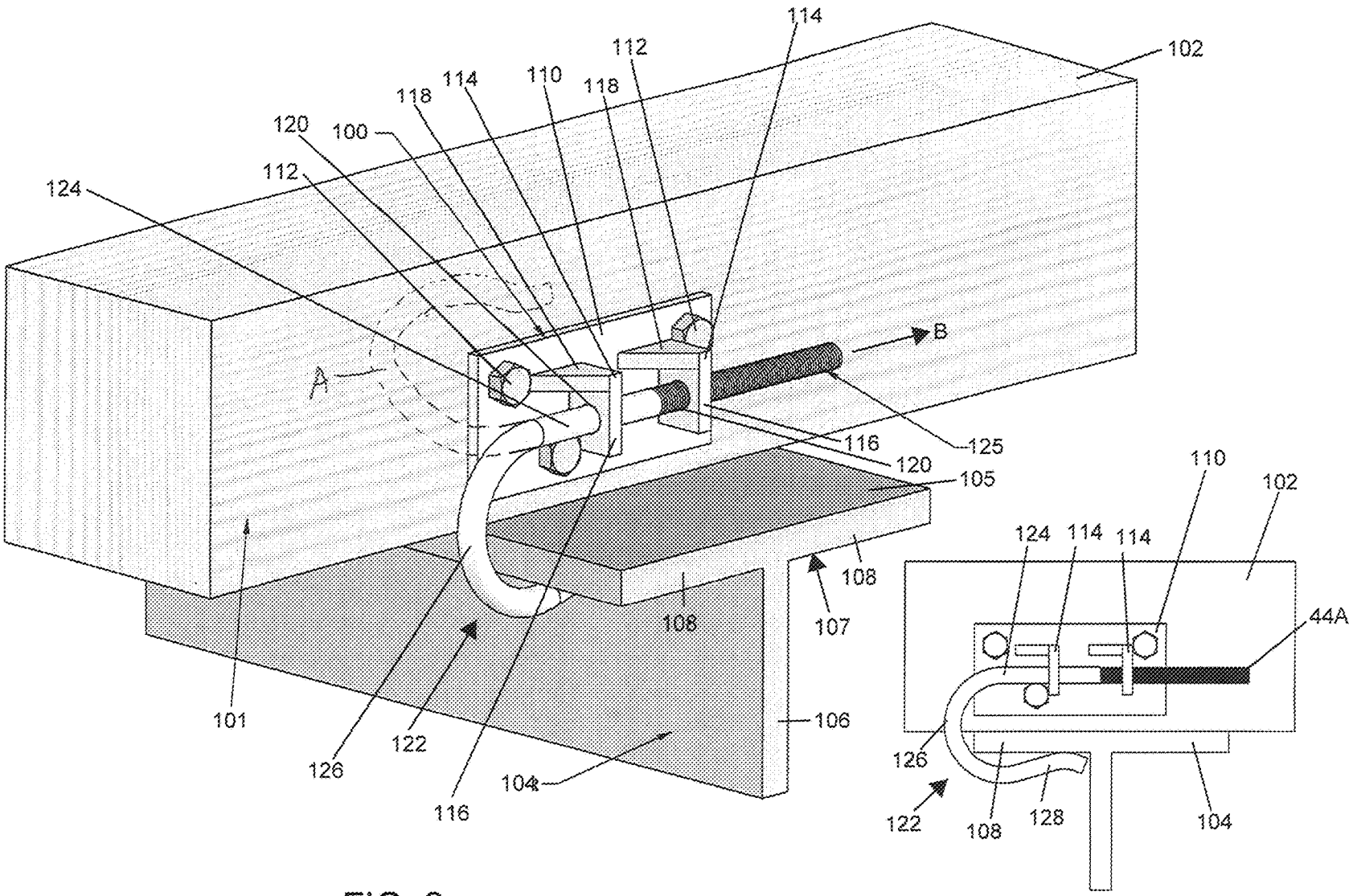
FIG. 2 is a perspective view of a railroad tie fastened to a girder according to an exemplary embodiment of the present disclosure.
FIG. 3 is a front elevation view of the fastening system of FIG. 2 according to an exemplary embodiment of the present disclosure.
Figure 5:
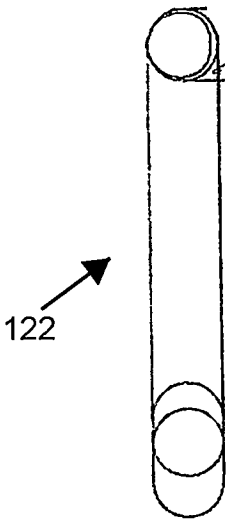
FIG. 5 is an end view of the clip of FIG. 4.
Figure 4:
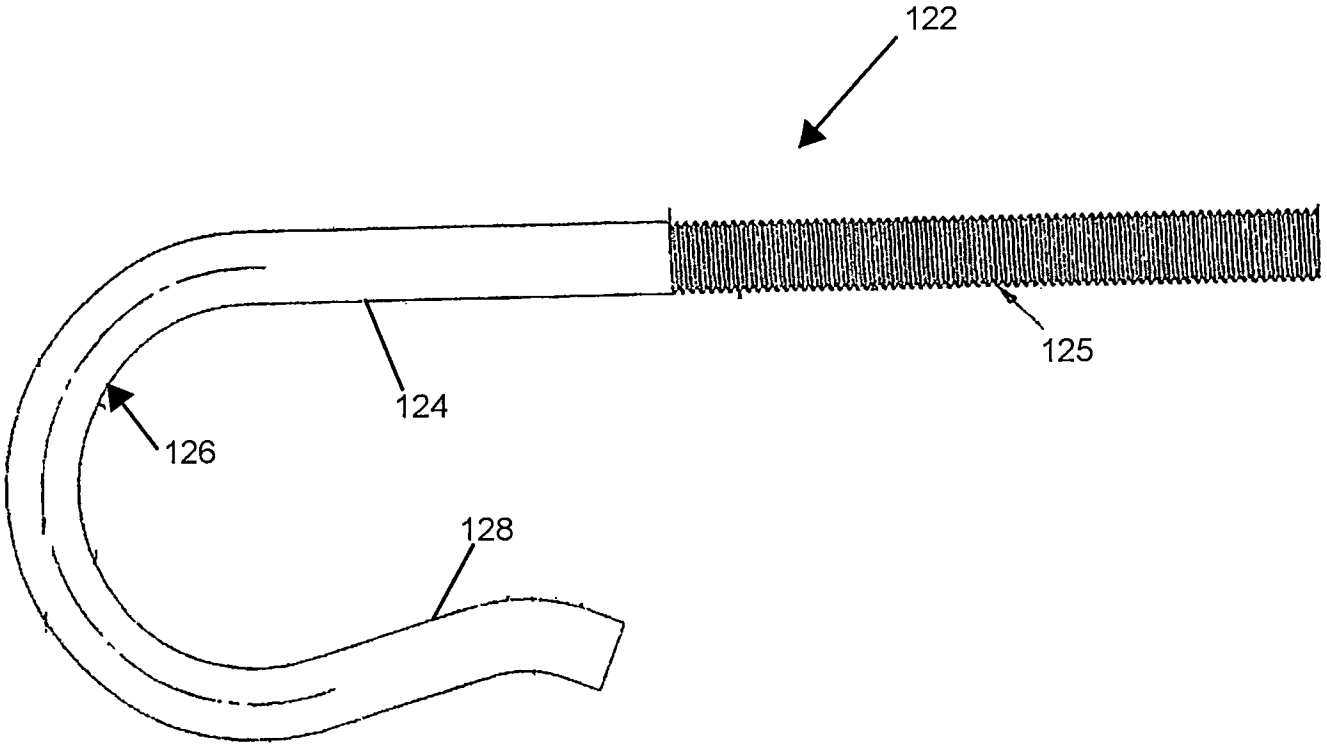
FIG. 4 is a front elevational view of a clip that is included as part of the fastening system of FIG. 2 according to an exemplary embodiment of the present disclosure.

FIGS. 2 and 3 show a crosstie 102 secured to a steel portion or girder 104 of a structure, such as an elevated bridge, by a railroad fastening system 100 according to an exemplary embodiment of the prevent invention. The crosstie 102 supports at least a pair of rails (not shown) using, for example, the rail seat assembly 10 that is illustrated in FIG. 1 and described above. However, the rail seat assembly 10 and/or another support assembly have been omitted in FIG. 2 for the sake of clarity. The girder 104 includes a web 106 and flanges 108.

The railroad fastening system 100 includes a plate 110 (e.g., metal, steel, etc.) that is attached a sidewall 101 of the crosstie 102 by a plurality of fasteners 112. The fasteners 112 can be, for example, bolts that include threaded and/or unthreaded shanks and are used in combination with or without a nut, screws, spikes, etc. Attached to the plate 110 are two flanges 114. Each flange 114 may include a wall 116 that extends vertically from the plate 110 and a support 118 that is included to ensure that the walls 116 can withstand large lateral forces without bending or breaking. Each wall 116 includes a through-hole 120. As shown in FIG. 2, the through-hole 120 is circular. Preferably, the plate 110 and the flanges 114 and manufactured as a single, unitary piece that can be, for example, about 230 mm by 110 mm and about 10 mm thick. The walls 116 can extend, for example, about 40 mm away from the plate 110. The plate 110 can be made of steel or another similar material.

The railroad fastening system 100 further includes a J-shaped clip 122 that, as can be seen, for example, in FIGS. 2-5, has a straight section 124, a rounded section 126 that extends contiguous from the straight section 124 and a tip 128 that is sized and shaped to contact and engage a flange 108 of the girder 104 as will be discussed in more detail below. The straight section 124 can include threading 125 that extends about an exterior thereof for at least a portion of the straight section 124. The clip 122 is comprised of steel and can be shaped from a rod having a round cross-section. The clip 122 can have a diameter of about 20 mm.

To secure the crosstie 102 to the steel structure 104, the railroad fastening system 100 is first attached to crosstie 102 by the fasteners 112 (e.g., bolts). This step can be performed remotely. Importantly, the walls 114 form sockets for the clip 122 with the clip 122 and the through-holes 120 forming interference or frictional fits to ensure that the clip 122 remains attached to the plate 110 and is not separated during transportation. Prior to the attachment of the crosstie 102 to the steel structure 104, the clip 122 can be turned about 180 degrees upward, in the position A shown by the broken lines in FIG. 2. In this position, the clip 122 is vertically oriented and in contact with the plate 110.

When the crosstie 102 is transported to the installation site and positioned on the girder 104, the clip 122 can then be rotated downward to the position shown in FIGS. 2 and 3. It should be noted that the clip 122 can be shifted to the left from the position shown to ensure that as it is rotated downward, the clip 122 clears the top surface 105 of the flange 104.

Next, the rounded section 126 is contacted laterally (e.g., with a hammer or other appropriate tool) to force the clip 122 to move laterally with respect to the plate 110, crosstie 102 and girder 104 in a direction B (see FIG. 2). The curved end 128 of the clip 122 is bent slightly downward and the clip 122 is shaped so that, before the clip 122 is forced in the direction B, the distance between the curved end 128 and the wall 114 is less than a distance between the wall 114 and a lower surface 107 of the flange 122. As a result, as the clip 122 moves laterally sideways as the clip 122 is contacted, the clip 122 is elastomerically deformed, allowing the curved end 128 to travels over the lower surface 107, creating a very strong friction force to secure the crosstie 102 to girder 104.

Importantly, the railroad fastening system 100 can be installed from the top of the crosstie 102, thereby ensuring that an individual(s) installing the system 100 does not have to work beneath the crosstie 102 and the girder 104. Moreover, the final position of the clip 122 is clearly visible from the top of the crosstie 102 so that the individual(s) installing the system 100 can be sure that the clip 122 has been installed correctly and securely. Due to the fact that the clip 122 is visible from above the crosstie 102, the fastening system 100 can be easily inspected, as desired, and the clip 122 can be replaced as necessary.

The surface of the clip 122 can be relatively smooth with, as noted above, at least portion 125 of the straight section 124 externally threaded to increase friction between the clip 122 and the walls 114 and prevent the clip 122 from sliding easily about the through-holes 120.

In the description provided above, a single railroad fastening system 100 is shown attached to a crosstie 102. However, two or more such railroad fastening systems 100 can be attached as necessary. Moreover, the fasteners 112 can be sized to penetrate only a part of a respective crosstie 102 to maintain structural integrity.

Figure 6:
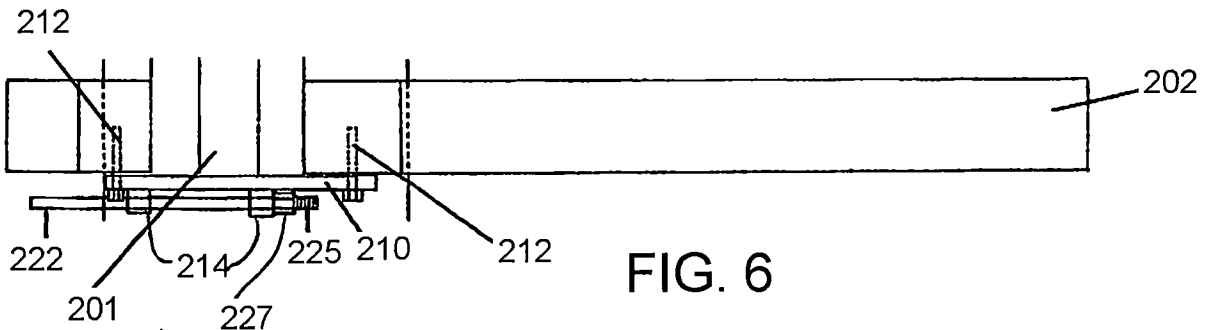
FIG. 6 is a top view of another fastening system according to an exemplary embodiment of the present disclosure.
Figure 8:
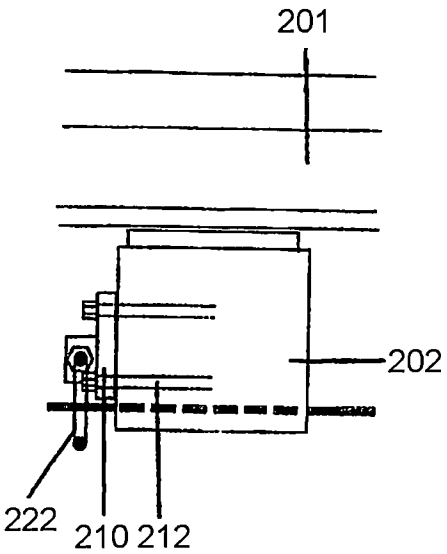
FIG. 8 is a side view of the fastening system of FIG. 6 according to an exemplary embodiment of the present disclosure.
Figure 7:
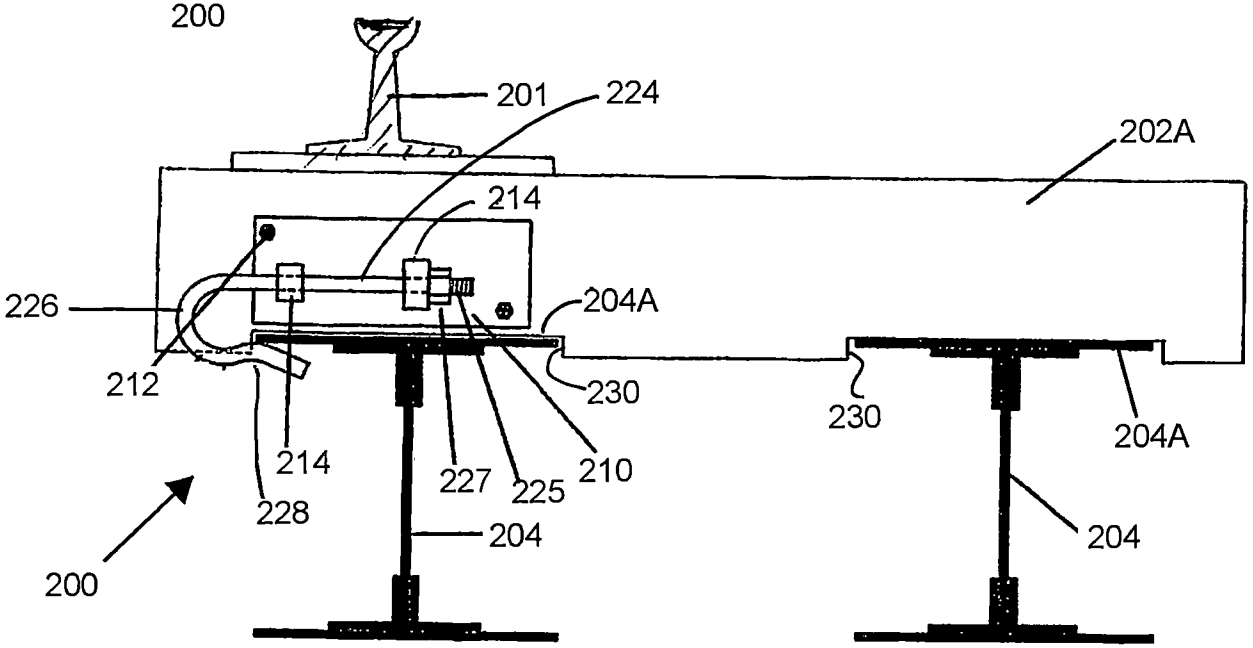
FIG. 7 is a front elevation view of the fastening system of FIG. 6 according to an exemplary embodiment of the present disclosure.

Another exemplary embodiment of a railroad fastening system 200 is shown in FIGS. 6-8. The railroad fastening system 200 includes a plate 210, which can, for example, be comprised of metal or steel that is fastened to the side of a crosstie 202 and is oriented in both a vertical direction and perpendicular to a direction of the rails 201 above the crosstie 202 and a structural support, such as a girder, 204 below the ties. The plate 210 is thus not a hazard on the top or side face of the crosstie 202 and is not difficult to access on the bottom facing part of the crosstie 202.

There may be two (or more) plates 210 near the end of each crosstie 202. Each plate 210 may be secured to the side of the crosstie 202 by a plurality of fasteners 212. The fasteners 212 can be, for example, bolts that include threaded and/or unthreaded shanks and are used in combination with or without a nut, screws, spikes, etc. in an embodiment, at least two fasteners 212 are required to secure the plate 210 to a crosstie 202. The fasteners 210 penetrate a side of the crosstie 202 and, thus, run parallel to the structural support 204, below and the crossties 202 located above the structural support 204. Importantly, the fasteners 210 do not extend all of the way through the crosstie 202 and, as a result, maintain the integrity of the crosstie 202. In another embodiment, the fasteners 210 can extend through the crosstie 202. These fasteners 210 do not impact the top and bottom profile of the crossties 202.

Attached to the plate 210 are two flanges 214. Each flange 214 extends vertically away from the plate 210. Each flange 214 includes a through-hole (not shown). The plate 210 and the flanges 214 can be manufactured as a single, unitary piece. The flanges 214 can include threaded openings and can be, for example, attached to the plate 210 by welding or other conventional means.

Like the fastening system 100 described above, the fastening system shown in FIGS. 6-8 includes a clip 222, which is made of a resilient material (e.g., steel, metal, etc.). The clip 222, which has a J-shape, includes a straight section 224, a rounded section 226 that extends contiguous from the straight section 224 and a countered tip 228 that extends contiguous from the rounded section 226 and that is configured to resiliently contact and engage a flange 208 of the girder 204 as will be discussed in more detail below to secure the crosstie 202 to the girder 204. The straight section 224 can include threading 225 that extends about an exterior thereof for at least a portion of the straight section 224. The straight section 224 of the clip 222 is oriented parallel to the plate 210 and the crosstie 202, extends at least half of the length of the plate 202, preferably most of the length of the plate 210 and extends through openings (not shown) in the flanges 214 to securely attached the clip 222 to the plate 210.

The threading 225 of the straight section 224 is configured to mate with internal threading of a nut 227 that can be used to adjust the position of clip 220 in relation to the plate 210, crosstie 202 and/or structural support 204. Turning the nut 227 to engage the bolt threads 225 advances the clip 222 along the plate 210 and secures the hook end 228 of the clip 222 to the top 205 of the flanged portion of the structural support 204.

The hook end 228 of the clip 222 is oriented so that the hook end 228 points down such that contoured tip 228 can couple with the lower flanged edge 207 of the structural support 204 that run under the crosstie 202 with the coupling being visible and achievable from the top side of the crosstie 202. The contoured tip 228 is configured such that it can compress against the underside 207 of a flanged portion 208 of the structural support 204, thereby coupling the crosstie 202 to the structural support 204 in a compression arch. Thus, the hook end 228 is resiliently deformable to aid in securing the crosstie 202 to the girder 204.

Advancing the clip 222 with the nut 227 further advances the clip 22 along the underside 207 of the structural support 204. Because of the position of the plate 210 and the clip 222, this attachment can be accomplished by one person avoiding trial and error type positioning of the clip 222 and/or the crosstie 202. The contoured tip 228 of the clip 222 is elastically flexible, thereby allowing lateral and vertical movement of the crosstie 202 relative to the structural support 204, which can occur under different weather and load conditions without thereby uncoupling the crosstie 202 from the structural support 204. The resilient clip 222 is configured to transmit lateral and vertical forces between the plate 210 and the flange 208 of the structural support 204.

A second fastening system that includes plate with a flange or flanges, fasteners, clip, and a nut similar or identical to the fastening system 200 described above can be used on both horizontal sides of a railroad crosstie, thereby securely attaching the crosstie in two positions to the structural support or girder below. This side fastening system could be pre-fabricated on railroad crossties, decreasing railroad crosstie installation time and cost. The side fastening system avoids extraneous fasteners from protruding from the top surface of the crossties, reducing occupational hazards.

As can be seen in FIG. 7, at least one additional plate 104A can be installed on top and attached to the flanges 208 of the structural support 204. A crosstie 202A can include one or more cutouts 230 to receive the additional plate 204A and further ensure that the crosstie 202A does not shift.

The invention is adaptable to different thicknesses of structural supports or girders, different thickness of crossties and various other supporting structures.

Although this invention has been disclosed in the context of certain embodiments and examples, it will be understood by those skilled in the art that the invention extends beyond the specifically disclosed embodiments to other alternative embodiments and/or uses of the invention and obvious modifications and equivalents thereof. It is to be understood that the phraseology or terminology employed herein is for the purpose of description and not of limitation. In addition, while several variations of the embodiments of the invention have been shown and described in detail, other modifications, which are within the scope of this invention, including, but not limited to, the substitutions of equivalent features, materials, or parts, will be readily apparent to those of skill in the art based upon this disclosure without departing from the spirit and scope of the invention.

What is claimed is:

1. A railway fastening system for fastening railway crossties to at least one support structure, comprising:

a plate that is configured to be mounted to a side of the crosstie in a vertical plane with respect to the side of the crosstie and perpendicular to a rail above the crosstie; and a resilient clip slidably attached to the plate and including a linearly extending section, a curve section extending contiguously from the linearly extending section and a contoured tip extending contiguously from the curved section, wherein the contoured tip is configured to contact a surface of the support structure and secure the crosstie to the support structure, and wherein the clip can be advanced along the plate and along an underside of the support structure to secure the crosstie to the support structure.

2. A fastening system securing a railroad crosstie to a support structure, the railroad crosstie having a top surface supporting a rail and a side surface, the support structure having a flange with an upper surface and a bottom surface, the fastening system comprising:

a plate having at least one flange extendable therefrom with the at least one flange having an opening extending therethrough the plate being fixable to the side surface of the crosstie; and a clip having a first segment extendable horizontally through the opening in the at least one flange of the plate, a second segment, which is curved, extending contiguous from the first segment and a third segment, which is contoured, extending contiguous from the second segment and engageable with the bottom surface of the flange of the support structure when the crosstie is installed on the upper surface of the support structure with the clip generating a friction force between said crosstie and the support structure.

3. The fastening system of claim 2, wherein the first segment has a surface that interacts with and forms an interference fit with the opening in the at least one flange of the plate.

4. The fastening system of claim 2, wherein a region of the first segment is threaded.

5. The fastening system of claim 4, further comprising a nut engaging the region of the first segment that is threaded causing the dip to move horizontally with respect to the plate to selectively capture the flange of the plate.

6. The fastening system of claim 2, wherein the clip is rotatable about the first segment thereof between a first position in which the third segment is above the flange of the support structure and a second position in which the third segment is below the flange of the support structure when the plate is attached to the crosstie.

7. The fastening system of claim 2, further comprising mounting components to attach the plate to the side of the crosstie.

8. In a railroad system including rails supported on crossties, a method of anchoring at least one of the crossties to a support structure that includes a flange that has a top surface and a bottom surface, the method comprising:

providing a fastening system that includes a plate having at least one flange extendable therefrom with an opening extending through the flange and a clip having a first segment that extends linearly, a second segment, which is curved, extending contiguous from the first segment and a third segment, which is contoured, extending contiguous from the second segment;

attaching the plate to a side surface of the at least one of the crossties;

placing the at least one of the crossties on the top surface of the support structure;

inserting the first segment of the clip through the opening in the at least on flange of the fastening system such that the first segment of the clip extends along a side surface of the at least one of the crossties;

rotating the third segment of the clip from a first position above the top surface of the support structure to a second position below the top surface of the support structure; and advancing the clip laterally through the opening in the at least one of the flange of the fastening system with the clip end extending along the bottom flange surface to secure the tie to the flange of the support structure.

9. The method of claim 8, wherein the step of advancing the clip is done by contacting the clip.

10. The method of claim 8, wherein the first segment has a threaded region, and the fastening system includes a nut engaging the threaded region and the dip is advanced by turning the nut.

* * * * *